US008289110B2

(12) United States Patent
Niimi et al.

(10) Patent No.: US 8,289,110 B2
(45) Date of Patent: Oct. 16, 2012

(54) ELECTROMAGNETIC SWITCHING DEVICE

(75) Inventors: Masami Niimi, Handa (JP); Yoshinori Yamaguchi, Kariya (JP); Kiyokazu Haruno, Anjo (JP)

(73) Assignee: Denso Corporation, Kariya (JP)

( * ) Notice: Subject to any disclaimer, the term of this patent is extended or adjusted under 35 U.S.C. 154(b) by 77 days.

(21) Appl. No.: 12/914,080

(22) Filed: Oct. 28, 2010

(65) Prior Publication Data

US 2011/0095852 A1 Apr. 28, 2011

(30) Foreign Application Priority Data

Oct. 28, 2009 (JP) ..... 2009-247234

(51) Int. Cl.
*H01H 67/02* (2006.01)

(52) U.S. Cl. ..... 335/126; 335/132

(58) Field of Classification Search ..... 335/126
See application file for complete search history.

(56) References Cited

U.S. PATENT DOCUMENTS

| | | | | |
|---|---|---|---|---|
| 5,214,401 | A * | 5/1993 | Kimura et al. | 335/126 |
| 5,227,751 | A * | 7/1993 | Shiroyama et al. | 335/126 |
| 6,286,378 | B1 * | 9/2001 | Kamei et al. | 74/7 A |
| 6,937,123 | B2 * | 8/2005 | Imanishi et al. | 335/126 |
| 7,549,899 | B2 * | 6/2009 | Imanishi et al. | 439/877 |
| 7,570,138 | B2 * | 8/2009 | Hirabayashi | 335/131 |
| 2002/0067231 | A1 * | 6/2002 | Kurasawa et al. | 335/126 |
| 2007/0069840 | A1 * | 3/2007 | Masaki | 335/126 |
| 2009/0183595 | A1 | 7/2009 | Niimi | |

FOREIGN PATENT DOCUMENTS

JP A-2009-191843 8/2009

* cited by examiner

*Primary Examiner* — Elvin G Enad
*Assistant Examiner* — Lisa Homza
(74) *Attorney, Agent, or Firm* — Oliff & Berridge, PLC

(57) ABSTRACT

In an electromagnetic switch device, a direction where a first plunger moves at the time a solenoid for pinion extrusion operates and a direction where a second plunger moves at the time a solenoid for motor energization operates are constituted in the same direction. A concave portion having a predetermined depth D is formed in a first fixed iron core used for the solenoid for pinion extrusion and a stopper member that controls a returning position of the second plunger is arranged therein. A part of the second plunger overlaps to the first fixed iron core in the axial direction.

10 Claims, 6 Drawing Sheets

ELECTROMAGNETIC SWITCHING DEVICE

CROSS-REFERENCE TO RELATED APPLICATION

This application is based on and claims the benefit of priority from earlier Japanese Patent Application No. 2009-247234 filed Oct. 28, 2009, the description of which is incorporated herein by reference.

TECHNICAL FIELD

The present disclosure relates to electromagnetic switching devices for starters, particularly for an electromagnetic switching device that has a solenoid for pinion extrusion and a solenoid for motor energization accommodated inside one cylindrical case unitarily.

BACKGROUND

Although the loading position of the starter in an engine compartment is usually a place close to and beside the engine, functional components with a higher priority for the engine performance, such as an intake manifold, are arranged around the engine in many cases.

For this reason, the outer diameter size of the starter used only for starting the engine is often restricted. Therefore, in order to secure the market competitiveness of the product itself, improving an ease of arrangement of the starter by miniaturization is important.

On the other hand, adoption of an idle stop system is predicted to increase from now on for the improvement in fuel consumption resulting from a global warming issue.

However, since the number of times of starting engines will increase rapidly if the idle stop system is adopted, therefore, durability of the starter, the improvement in reliability over a long period of time, and reduction of operation sound are needed.

Here, in durability, the improvement in durability of a pinion and a ring gear is an important subject.

For improving durability, a method of engaging the pinion with the ring gear needs to be improved, and one way of achieving this is to ensure the timing of pushing out the pinion and energizing a motor is accurate.

As conventional technology realizable that improves the above-mentioned ease of arrangement and durability is well known in Japanese Patent Publication No. 2009-191843.

JP 2009-191843 discloses an electromagnetic switch device that has a solenoid for pinion extrusion that extrudes the starter's pinion to the engine side and a solenoid for motor energization that opens and closes a main switch provided in a motor circuit of the starter, and operations of the both solenoids can be controlled independently.

By the way, if the spread of idle stop systems, i.e. to make them become more popular, is taken into consideration, the cost also becomes an important subject. Especially, when replacing the conventional starters to the starters for idle stop system, the starters are replaced one by one for every area and a type of a car.

In the meantime, it is necessary to produce conventional starters and starters for idle stop systems in parallel and this situation is expected to continue for a considerably long period of time, thus the cost including this period must be considered.

As a cost reduction measure in this case, common parts usage is mentioned as an important means. However, the electromagnetic switch device disclosed in the above-mentioned JP 2 009-191843 h as a large effect on the ease of arrangement, a subject in respect of the common parts usage with the electromagnetic switch used for the conventional starter.

That is, although the solenoid for pinion extrusion disclosed in JP 2 009-191843 can share coils, plungers, etc. with the parts used for the electromagnetic switch of conventional starters, many parts cannot be shared for the solenoid for motor energization.

SUMMARY

An embodiment provides an electromagnetic switch device that can reduce cost by sharing parts with the conventional starter currently used for the electromagnetic switch, and improves the ease of arrangement of the starter by shortening the overall length of the electromagnetic switch In an electromagnetic switching device according to a first aspect, the electromagnetic switching device includes a solenoid for pinion extrusion and a solenoid for motor energization.

The solenoid for pinion extrusion includes a first coil that forms an electromagnet by energization, a first fixed iron core that is magnetized by the energization to the first coil, and a first plunger that moves in an inner circumference of the first coil in an axial direction by attraction of the magnetized first fixed iron core.

The pinion disposed on a starter's output shaft extruded by an engine's ring gear side interlocking with a movement of the first plunger.

The solenoid for motor energization includes a second coil that forms an electromagnet by energization, a second fixed iron core that is magnetized by the energization of the second coil, and a second plunger that moves in an inner circumference of the second coil in an axial direction by attraction of the magnetized second fixed iron core.

A main switch that intermits a current flowing to a starter motor interlocking with a movement of the second plunger The solenoid for pinion extrusion and the solenoid for motor energization are arranged in line in an axial direction.

There is provided a cylindrical case with a bottom in one side and an opening in another side, the solenoid for pinion extrusion is accommodated in the bottom side of the case and the solenoid for motor energization is accommodated in the opening side of the case to constitute the electromagnetic switching device for starters unitarily.

The solenoid for pinion extrusion and the solenoid for motor energization are so constituted that a direction where the first plunger moves by attraction of the first fixed iron core and a direction where the second plunger moves by attraction of the second fixed iron core are in the same direction.

The first fixed iron core of the solenoid for pinion extrusion is constituted of a ring-shaped iron core plate arranged at a top side of the case to the first coil, and an iron core part provided unitarily with an inner circumference side of the iron core plate arranged at an inner circumference of the first coil facing the first plunger.

The first fixed iron core has its anti-plunger side end surface of the iron core part depressed a predetermined depth D from an anti-coil side end surface of the iron core plate.

The solenoid for motor energization has a stopper member made of nonmagnetic materials that suppresses a stopping position of the second plunger at the time where the energization to the second coil is stopped.

The stopper member is arranged at a concave portion that is depressed the predetermined depth D of the first fixed iron core.

In the electromagnetic switch device of the present invention, the direction where the first plunger moves by the attraction of the first fixed iron core and the direction where the second plunger moves by the attraction of the second fixed iron core are constituted in the same direction.

Thereby, the composition of the main switch can be shared with the electromagnetic switch of the conventional starter.

Specifically, the moving contact that intermits (i.e. intermittently opens and closes) between the set of fixed contacts, the insulator that maintains the moving contact insulated against the plunger rod, and the like can be shared.

Since the concave portion having a predetermined depth D is formed in the first fixed iron core, the length of the electromagnetic switching device in the axial direction can be shortened as compared with the case where forming the anti-plunger side end surface of the iron core part and the anti-coil side end side of the iron core plate the same plane, and arranging the stopper member on the plane, thus improving the ease of arrangement of the starter.

In an electromagnetic switching device according to a second aspect, a thickness t of the stopper member is formed smaller than the depth D of the concave portion formed in the first fixed iron core, and a part of the second plunger overlaps the first fixed iron core in the axial direction only by the difference (D−t) of the depth D of the concave portion and the thickness t of the stopper member.

In an electromagnetic switching device according to a third aspect, the case comprises a first case that forms a yoke of the pinion solenoid and a second case that forms a yoke of the motor solenoid unitarily formed and arranged in line in an axial direction, and a thickness of a portion that connects between the first case and the second case is formed smaller than the cross-sectional areas of a magnetic circuit of the pinion solenoid and the magnetic circuit of the motor solenoid, respectively.

In an electromagnetic switching device according to a fourth aspect, the motor solenoid has a plunger rod provided separately from the second plunger that supports a moving contact of the main switch, and the second plunger is constituted of substantially pillar-shaped member of magnetic materials.

In an electromagnetic switching device according to a fifth aspect, a penetration hole is provided that penetrates a central part of the iron core part in an axial direction and a guiding member made of non-magnetic materials is provided to the penetration hole.

The guiding member is formed either unitarily or separately with the stopper member and has a guide hole that penetrates in an axial direction at the radial center of the guiding member.

The second plunger is provided with a plunger axis part that projects in an axial direction (direction towards the first plunger) from a central part in a radial direction of a surface of the second plunger that contacts the stopper member at the time where the energization to the second coil is stopped, and the plunger axis part is inserted in the guide hole and supported movably in the axial direction via the guiding member.

In an electromagnetic switching device according to a sixth aspect, a gap formed between an inner diameter of the guide hole and the outer diameter of the plunger axis part is smaller than a gap formed between an outer diameter of the second plunger and an inner diameter of a bobbin that the second coil is wound.

In an electromagnetic switching device according to a seventh aspect, a penetration hole is formed in the iron core part that penetrates a central part thereof, and a cylindrical or columnar buffer body made of a non-magnetic elastic body that projects in an axial direction (direction towards the first plunger) from a surface of the iron core part side is provided unitarily with the stopper member.

The buffer body is inserted into the penetration hole, and a tip surface of the buffer body is projected from attraction side of the iron core part that faces the first plunger.

In an electromagnetic switching device according to an eighth aspect, the electromagnetic switching device includes a solenoid for pinion extrusion and a solenoid for motor energization.

The solenoid for pinion extrusion includes a first coil that forms an electromagnet by energization, a first fixed iron core that is magnetized by the energization to the first coil, and a first plunger that moves in an inner circumference of the first coil in an axial direction by attraction of the magnetized first fixed iron core.

The pinion disposed on a starter's output shaft extruded by an engine's ring gear side interlocking with a movement of the first plunger.

The solenoid for motor energization includes a second coil that forms an electromagnet by energization, a second fixed iron core that is magnetized by the energization of the second coil, and a second plunger that moves in an inner circumference of the second coil in an axial direction by attraction of the magnetized second fixed iron core.

A main switch that intermits a current flowing to a starter motor interlocking with a movement of the second plunger.

The solenoid for pinion extrusion and the solenoid for motor energization are arranged in line in an axial direction.

There is provided a cylindrical case with a bottom in one side and an opening in another side, the solenoid for pinion extrusion is accommodated in the bottom side of the case and the solenoid for motor energization is accommodated in the opening side of the case to constitute the electromagnetic switching device for starters unitarily.

The solenoid for pinion extrusion and the solenoid for motor energization are so constituted that a direction where the first plunger moves by attraction of the first fixed iron core and a direction where the second plunger moves by attraction of the second fixed iron core are in the same direction.

In an electromagnetic switching device according to a ninth aspect, the case is provided unitarily with a first case that forms a yoke of the pinion solenoid and a second case that forms a yoke of the motor solenoid arranged in line in an axial direction, and a thickness of a portion that connects between the first case and the second case is formed smaller than the cross-sectional areas of a magnetic circuit of the pinion solenoid and the magnetic circuit of the motor solenoid, respectively.

DETAILED DESCRIPTION OF THE PREFERRED EMBODIMENTS

With reference to the accompanying drawings, hereinafter will be described some embodiments of the present disclosure.

EMBODIMENTS

First Embodiment

Figure 2:
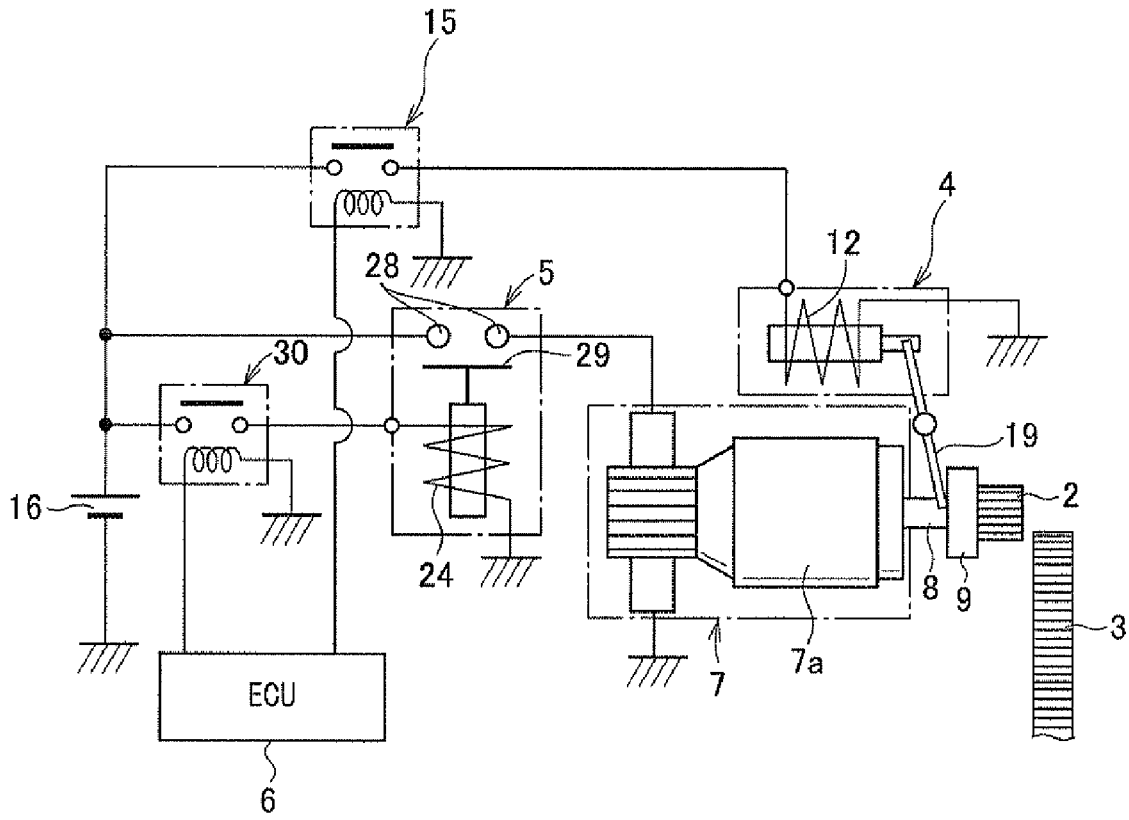
FIG. 2 shows a starter's electric circuit.

As shown in FIG. 2, an electromagnetic switching device 1 of the present embodiment includes a solenoid for pinion extrusion 4 (hereafter called "pinion solenoid") that extrudes a starter's pinion 2 to an engine 3 side, and a solenoid for motor energization 5 (hereafter called "motor solenoid") that opens and closes a main switch (mentioned later) provided in a motor circuit of the starter.

The starter having this electromagnetic switching device 1 is applied to a vehicle equipped with an idle stop system that controls a stop and a re-start of an engine automatically, and is constituted so that operations of the pinion solenoid 4 and the motor solenoid 5 can be independently controlled by an idle stop ECU 6, which is an electrical control unit.

A main body of the starter except the electromagnetic switching device 1 has a well-known composition wherein the torque generated on a motor 7 is amplified by a reduction gear (amplification by the reduction gear may not be necessary) and transmitted to an output shaft 8, and transmitted to the pinion 2 via an one-way clutch 9 arranged on a perimeter of the output shaft 8.

Figure 1:
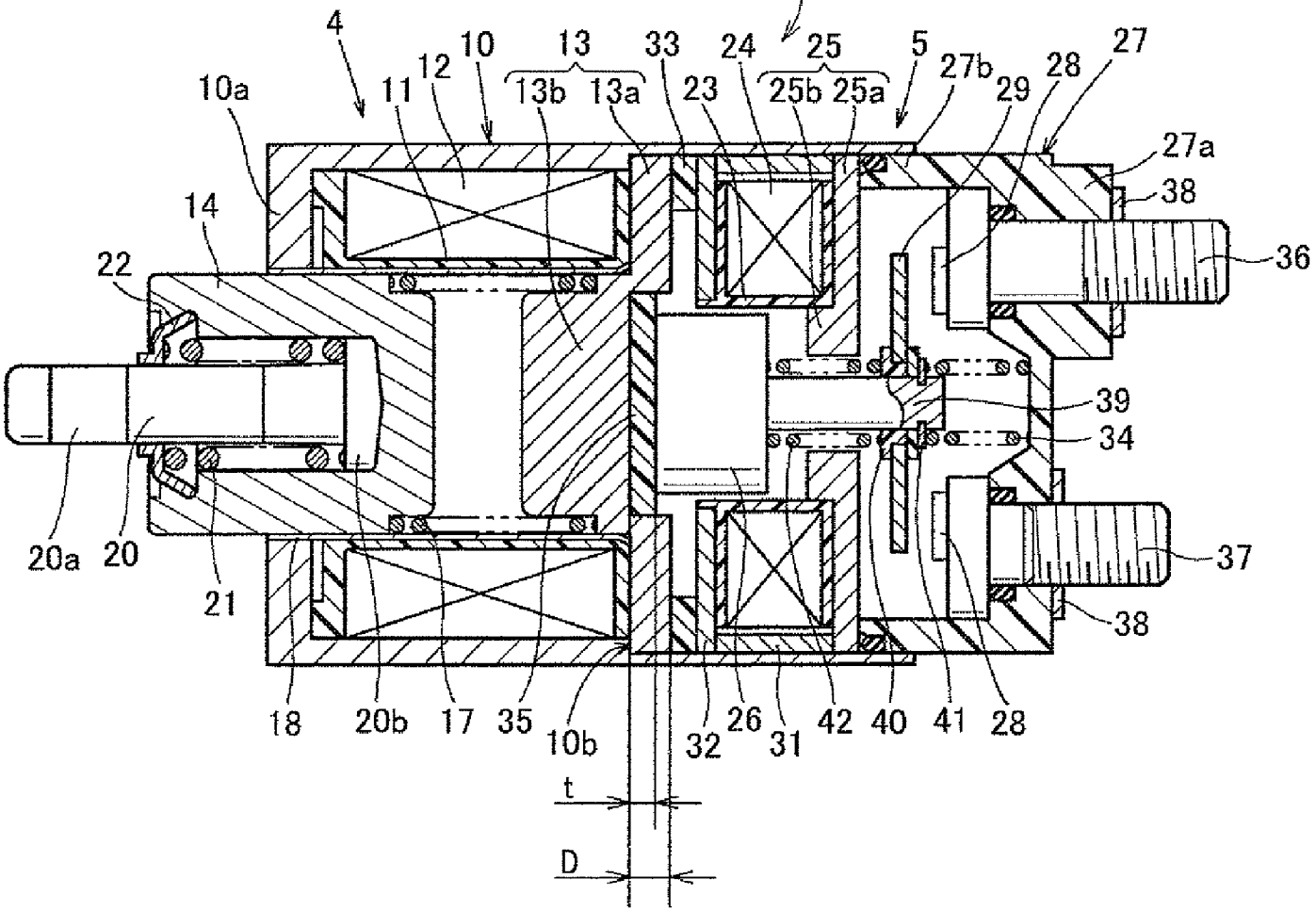
FIG. 1 shows a sectional view of an electromagnetic switch device shown in a first embodiment.

Hereafter, the composition of the electromagnetic switching device 1 is explained in detail based on FIGS. 1 and 2.

As shown in FIG. 1, the pinion solenoid 4 and the motor solenoid 5 are arranged axially in line (horizontal direction in the figure), and are accommodated inside one whole case 10 and constituted unitarily.

The whole case 10 has a first case that forms a yoke of the pinion solenoid 4 and a second case that forms a yoke of the motor solenoid 5. Both cases are arranged in line in an axial direction and formed unitarily.

The whole case 10 has a cylindrical shape with a bottom that has a ring-shaped bottom 10*a* provided in an end portion of one end that forms the first case, and an opening provided in an end portion of another end that forms the second case.

The whole case 10 is fixed to a starter's housing (not shown) via two stud bolts (not shown) provided in the bottom 10*a*.

The whole case 10 has an outer diameter with the same size from one end to the other end, and one end side (opening side of the whole case 10) that forms the second case has a larger inner diameter and a thinner wall thickness than other side that forms the first case.

That is, a level difference 10*b* is provided on an inner circumference of the whole case 10 between the one end side in the axial direction that forms the first case and the other end side in the axial direction that forms the second case.

The pinion solenoid 4 has a first coil 12 wound around a resin bobbin 11, a first fixed iron core 13 magnetized by energization of the first coil 12, a first plunger 14 moves in an inner circumference of the first coil 12 in an axial direction (horizontal direction in FIG. 1), and the like.

As shown in FIG. 2, one end of the first coil 12 is connected to a battery 16 via a starter relay 15, and another end of the first coil 12 is grounded via the whole case 10. The starter relay 15 is controlled by energization by the idle stop ECU 6.

As shown in FIG. 1, the first fixed iron core 13 is constituted of a ring-shaped iron core plate 13*a* arranged at another end side in an axial direction of the first coil 12 and an iron core part 13*b*. The iron core part 13*b* is provided unitarily with the inner circumference side of the iron core plate 13*a*, and arranged at the inner circumference of the first coil 12.

A perimeter end surface in the first coil 12 side of the iron core plate 13*a* contacts with the level difference 10*b* provided in an inner circumference of the whole case 10 so that the first fixed iron core 13 is positioned in an axial direction.

The first fixed iron core 13 has its anti-plunger side end surface of the iron core part 13*b* depressed a predetermined depth D from an anti-coil side end surface of the iron core plate 13*a*.

Hereafter, a portion that is depressed the predetermined depth D is called a concave portion of the first fixed iron core 13.

When the first fixed iron core 13 is magnetized by the energization to the first coil 12, the first plunger 14 is adsorbed to one attraction side of the anti-core part 13*b* (left end surface of FIG. 1) resisting an elasticity of a return spring 17 arranged between the first plunger 14 and the core part 13*b*.

When the energization to the first coil 12 stops, the first plunger 14 is pushed back in the direction of an anti-core part (left of FIG. 1) by the elasticity of the return spring 17.

A cylindrical sleeve 18 that guides a movement of the first plunger 14 is inserted in the inner circumference of the bobbin 11.

The first plunger 14 is formed approximately in the cylindrical shape with a central cylindrical hole in a radial direction. The cylindrical hole opens to one end side of the plunger 14 while the other end side of the plunger 14 has a bottom.

A joint 20 for transmitting a motion of the first plunger 14 to a gearshift 19 (referring to FIG. 2) and a drive spring 21 that stores an elasticity for engaging the pinion 2 to the ring gear 3 are inserted in the cylindrical hole of the first plunger 14.

The joint 20 is formed in a rod-shape, and an engagement slot 20*a* where one end portion of a gearshift 19 engages is formed in an end portion of one end side that projects from the cylindrical hole of the first plunger 14, while a flange part 20*b* is provided in an end portion of other end side.

The flange part 20*b* has an outer diameter that can slide on the inner circumference of the cylindrical hole of the plunger 14, and is pressed to the bottom of the cylindrical hole in response to the load of the drive spring 21.

The drive spring 21 is placed between a spring receptacle part 22 that is crimp-fixed to the opening end of the first plunger 14, and the flange part 20*b* of the joint 20.

When the first plunger 14 is attracted by the core part 13*b* and moves, the first plunger 14 is compressed and conserves the elasticity while the first plunger 14 is adsorbed to one attraction side of the core part 13*b*, after an end surface in an axial direction of the pinion 2 pushed out in an anti-motor direction (right of FIG. 2) via the gearshift 19 contacts an end surface in an axial direction of the ring gear 3.

The motor solenoid 5 has a second coil 24 wound around a resin bobbin 23, a second fixed iron core 25 magnetized by energization to the second coil 24, a second plunger 26 moves an inner circumference of the second coil 24 in an axial direction (horizontal direction in FIG. 1), a resin cover 27 attached to and closes an opening that opens in another end of the whole case 10, and the like.

A set of fixed contacts 28 and a moving contact 29 that constitute a main switch are arranged inside the resin cover 27.

As shown in FIG. 2, one end of the second coil 24 is connected to a battery 16 via a motor relay 30, and another end of the second coil 24 is grounded via the whole case 10. The motor relay 30 is controlled by energization by the idle stop ECU 6.

The second fixed iron core 25 is constituted of a ring-shaped iron core plate 25*a* arranged at another end side in an axial direction of the second coil 24 and an iron core part 25*b*. The iron core part 25*b* is provided unitarily with the inner circumference side of the iron core plate 25*a*, and arranged at the inner circumference of the second coil 24.

A cylindrical auxiliary yoke 31 and a plate-like magnetic path member 32 that form parts of magnetic circuit are arranged at an outside in a radial direction of the second coil 24 and one end side in an axial direction, respectively.

The auxiliary yoke 31 is arranged at the inner circumference of other one end of the whole case 10 that forms the second case, and is pinched between the perimeter part of the magnetic path member 32, and the perimeter part of iron core plate 25*a*.

The magnetic path member 32 is arranged intersecting perpendicularly to an axial direction of the second coil 24, and formed in a ring shape having a hole in a central part in a radial direction so that second plunger 26 can move in the axial direction.

A spacer member 33 made of a nonmagnetic material is disposed between the magnetic path member 32 and the iron core plate 13*a* of the first fixed iron core 13. A predetermined interval equivalent to a thickness of the spacer member 33 is secured between the magnetic path member 32 and the iron core plate 13*a*

When the second fixed iron core 25 is magnetized by the energization of the second coil 24, the second plunger 26 is adsorbed to one attraction side of the core part 25*b* (left end surface of FIG. 1) resisting a force of a return spring 34 (Refer to FIG. 1).

When the energization to the second coil 24 stops, the second plunger 26 is pushed back in the direction of an anti-core part (left of FIG. 1) by the elasticity of the return spring 17, and stops by contacting a stopper member 35, which is explained next.

The stopper member 35 is formed in a disk shape made of nonmagnetic materials, such as resin, and is arranged at the concave portion (the portion that is depressed the predetermined depth D) of the first fixed iron core 13, as shown in FIG. 1.

A thickness t of the stopper member 35 is formed smaller (thinner) than the depth D of the concave portion formed in the first fixed iron core 13, and in the state where an end surface of the second plunger 26 stops contacting a surface of the stopper member 35 (state shown in FIG. 1), a part of the second plunger 26 overlaps with the first fixed iron core 13 in the axial direction only by the difference (D−t), i.e. between of the depth D of the concave portion formed in the first fixed iron core 13 and the thickness t of the stopper member 35.

That is, in the state where an end surface of the second plunger 26 stops contacting a surface of the stopper member 35, a position in the axial direction of the end surface of the second plunger 26 enters into inside the concave portion from an anti-coil side end surface of the iron core plate 13*a*.

The resin cover 27 has a bottom portion 27*a* in which two terminal bolts 36 and 37 are attached, and cylindrical leg portion 27*b* prolonged in an axial direction from a perimeter of the bottom portion 27*a*.

The resin cover 27 is positioned in an axial direction by inserting a tip side of the leg portion 27*b* inside the inner circumference of the whole case 10, and an end surface in an axial direction of the leg portion 27*b* contacts the surface of an anti-coil side of the iron core plate 25*a*.

The resin cover 27 is fixed to the whole case 10 by crimping an end of the whole case 10 to a level difference part (not shown) formed in a perimeter surface of the leg portion 27*b*.

The terminal bolts 36 and 37 are a B terminal bolt 36 connected to a high potential side (battery side) of a motor circuit, and an M terminal bolt 37 connected to a low potential side (motor side) of the motor circuit.

The terminal bolts 36 and 37 are assembled to the resin cover 27 through penetration holes that penetrate the bottom portion 27*a* of the resin cover 27 in the axial direction, and each of the terminal bolts 36 and 37 is fixed to the resin cover 27 by crimp washers 38 (refer to FIG. 1).

A pair of the fixed contacts 28 is connected with the two terminal bolts 36 and 37 electrically and mechanically.

Although the fixed contact 28 and the terminal bolts 36 and 37 may be formed separately and join together, it is also possible to form the fixed contact 28 and the terminal bolts 36 and 37 unitarily using heads of the terminal bolts 36 and 37, for example.

The moving contact 29 is supported movably by a plunger rod 39 that is fixed to the second plunger 26 or formed unitarily to the second plunger 26 via a set of insulator 40 that are insulating members. A washer 41 fixed to the end the plunger rod 39 stops the moving contact 29 coming off from the plunger rod 39.

A contact pressure spring 42 is arranged in the perimeter of the plunger rod 39 between the second plunger 26 and the insulator 40.

The main switch becomes a closed state (ON) when the movable contact 29 pressed by the contact pressure spring 42 contacts with a pair of the fixed contacts 28 so that between both the fixed contacts 28 is electrically connected. The main switch becomes an opened state (OFF), however, when the movable contact 29 separates from a pair of the fixed contacts 28 so that the electrical connection between both the fixed contacts 28 is intercepted.

The above-mentioned return spring 34 is arranged between the washer 41 fixed to the plunger rod 39 and the internal end surfaces of the resin cover 27, and presses the second plunger 26 in the direction of the anti-iron core part 13*b*.

Thereby, when the second coil 24 is not energized, the second plunger 26 is pressed by the return spring 34 and the end surface of the second plunger 26 (end surface of an anti-plunger rod side) contacts with the surface of the stopper member 35 and stays still.

Next, the operation at the time of starting the engine with the starter of the present embodiment is explained.

The idle stop ECU 6 inputs, for example, an engine rotation signal, a position signal of a gear shift lever, ON/OFF signal of a brake switch, etc. through an engine ECU (not shown) that controls engine operational status, and if a condition precedent for stopping the engine is judged to have occurred based on these information, an engine stop signal is transmitted to the engine ECU.

The idle stop ECU 6 transmits a signal of a restart signal to the engine ECU and outputs an ON signal to the electromagnetic switching device 1 judging that a restart is required when operations in which a driver is going to start the vehicle (for example, a release operation of the brake, shift operation to a drive range, etc.) are performed, after the idle stop operation is performed.

Hereafter, an operation when a restart occurs in the engine stopping process (during a slowing down period until the engine stops completely) is explained as an example when an idle stop operation is performed.

The idle stop ECU 6 outputs an ON signal to the pinion solenoid 4 first when the restart occurs in the engine stopping process.

This energizes the first coil 12 from the battery 16 via the starter relay 15 (refer to FIG. 2).

Consequently, the first plunger 14 is attracted by the magnetized core part 13*b* and moves.

With the movement of the first plunger 14, the pinion 2 is pushed out in the anti-motor direction via the gearshift 19, and an end surface of the pinion 2 contacts an end surface of the ring gear 3.

Since rotation of engine is not stopped completely at this moment, that is, the ring gear 3 is rotating while slowing down, the pinion 2 engages to the ring gear 3 by the elasticity stored in the drive spring 21 at the time when the ring gear 3 comes to the position where the pinion 2 can be engaged.

The ON signal is outputted from the idle stop ECU 6 to the motor solenoid 6 delayed by a predetermined time (for example, 30 ms-40 ms) from the output timing of the ON signal to the pinion solenoid 5.

Thereby, the second coil 24 is energized from the battery 16 via the motor relay (refer to FIG. 2), and the second plunger 26 is attracted by the magnetized core part 25*b* and moves.

The movable contact 29 is pressed by the contact-pressure spring 42 with the movement of the second plunger 26, and the movable contact 29 contacts with the pair of the fixed contacts 28 so that the main switch closes.

Consequently, torque occurs in a rotor 7*a* (refer to FIG. 2) by the energization to the motor 7 from the battery 16, and the torque is transmitted to the output shaft 8, and is further transmitted to the pinion 2 via the clutch 9 from the output shaft 8.

Since the pinion 2 is already engaged to the ring gear 3, the torque of the motor 7 is transmitted to the ring gear 3 from the pinion 2, and starts the engine promptly.

The feature, the function and the effect of the electromagnetic switch device 1 shown in the first embodiment are explained hereafter.

In the electromagnetic switch device 1 of the present embodiment, the direction where the first plunger 14 moves at the time the pinion solenoid 4 operates (at the time when the first coil 12 is energized) and the direction where the second plunger 26 moves at the time the motor solenoid 5 operates (at the time of energization of the second coil 24) are constituted in the same direction (right of FIG. 1).

Thereby, the composition of the main switch can be shared with the electromagnetic switch of the conventional starter.

Specifically, the moving contact 29 that intermits between the set of fixed contacts 28, the insulator 40 that maintains the moving contact 29 insulated against the plunger rod 39, the washer 41 that stops the moving contact 29 coming off from the plunger rod 39, and the like can be shared. Moreover, the arrangement of the contact pressure spring 42 can also be shared.

Since the concave portion having a predetermined depth D is formed in the first fixed iron core 13 and the stopper member 35 is arranged therein, the length of the electromagnetic switching device 1 in the axial direction can be shortened as compared with the case of forming the anti-plunger side end surface of the iron core part 13*b* and the anti-coil side end side of the iron core plate 13*a* on the same plane, and arranging the stopper member 35 on the plane, for example.

Further, in the first embodiment, since the thickness t of the stopper member 35 is formed small (thinner) than the depth D of the concave portion, the part of the second plunger 26 overlaps the first fixed iron core 13 in the axial direction only by the difference (D−t) of the depth D of the concave portion and the thickness t of the stopper member 35 in the state where the end surface of the second plunger 26 stops contacting the surface of the stopper member 35, as shown in FIG. 1.

Since the length of the electromagnetic switch device 1 in the axial direction can be shortened even if the composition has the pinion solenoid 4 and the motor solenoid 5 arranged in line in the axial direction, it contributes to improving the ease of arrangement of the starter.

The whole case 10 that accommodates the pinion solenoid 4 and the motor solenoid 5 is provided unitarily with the first case that forms the yoke of the pinion solenoid 4 and the second case that forms the yoke of the motor solenoid 5 arranged in line in an axial direction, and a thickness of the portion (perimeter part of the spacer member 33) that connects between the first case and the second case is formed smaller than the cross-sectional areas of the magnetic circuit of the pinion solenoid 4 and the magnetic circuit of the motor solenoid 5, respectively.

By this, when the motor solenoid 5 is in operation, i.e., while the second coil 24 is energized, magnetic flux leakage to the pinion solenoid 4 can be suppressed.

Consequently, since the part of magnetic flux generated by the energization to the second coil 24 cannot easily reach the end surface of the second plunger 26 passing through the first fixed iron core 13 (especially the iron core plate 13*a*), the absorption power of the motor solenoid 5 does not decrease greatly In other words, since reduction of the absorption power of the motor solenoid 5 can be suppressed, enough power of absorption required in order to attract the second plunger 26 can be secured when the main switch is closed.

Second Embodiment

In the second and the subsequent embodiments, the components identical with or similar to those in the first embodiment are given the same reference numerals for the sake of omitting explanation.

Figure 3:
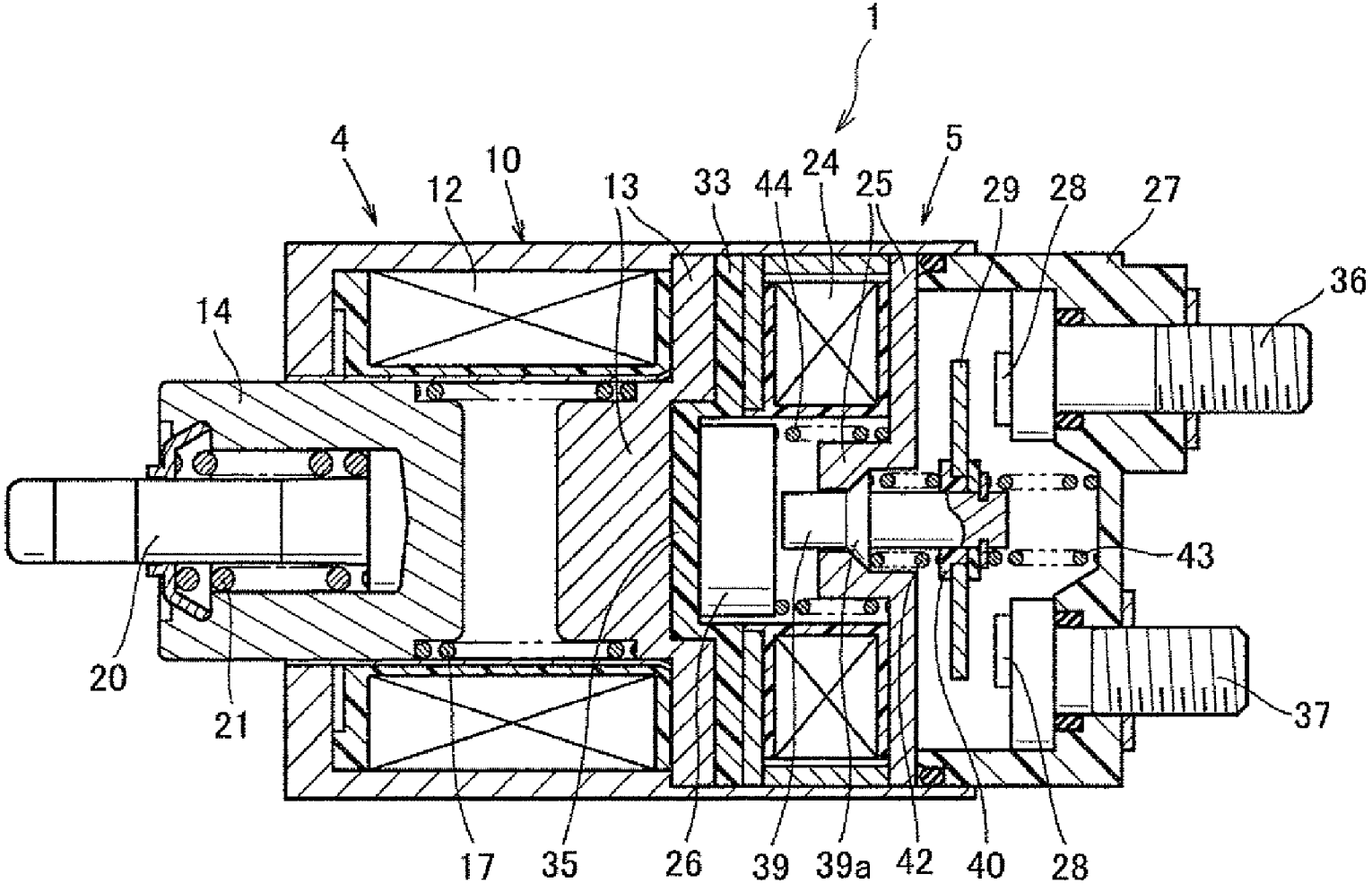
FIG. 3 shows a sectional view of the electromagnetic switch device shown in a second embodiment.

In the electromagnetic switch device 1 explained in this second embodiment shown in FIG. 3, a new feature is that the plunger rod 39 is separated from the second plunger 26.

A tapered step portion 39*a* is provided to the plunger rod 39 in the position nearer to the second plunger 26 side from the central part in the longitudinal direction (horizontal direction in the figure).

The tapered step portion 39*a* is formed in a tapered shape such that an outer diameter of the plunger rod 39 becomes gradually larger from the second plunger 26 side toward the moving contact 29 side (from left to right in the figure).

The contact pressure spring 42 is arranged between the end surfaces (the end surface that intersects perpendicularly with the axial direction of the plunger rod 39) of the tapered step portion 39*a* that has its maximum outer diameter and the insulator 40.

A tapered supporting surface (a hole in a tapering shape) that holds the tapered step portion 39*a* of the plunger rod 39 when the operation of the motor solenoid 5 is stopped is formed in a central part in a radial direction of the second fixed iron core 25.

That is, positioning of the plunger rod 39 in the axial direction and matching position of a central axis (prevention of the position gap in the radial direction) are performed when the tapered step portion 39*a* fits into the tapered supporting surface.

In the first embodiment, by the way, since the plunger rod 39 is fixed to the second plunger 26, the moving contact 29 is separated (pushed back) from the set of fixed contacts 28 when the energization to the second coil 24 is stopped.

Although one return spring 34 is used in order to push back the second plunger 26 and to press it against the stopper member 35 in the first embodiment (refer to FIG. 1), since the plunger rod 39 is provided separately from the second plunger 26 in the second embodiment, the return spring 34 shown in the first embodiment works as a moving contact return spring 43 for separating (pushing back) the moving contact 29 from the set of fixed contacts 28.

A plunger return spring 44 for pushing back the second plunger 26 is provided independently from the moving contact return spring 43.

According to the composition of the second embodiment, since the second plunger 26 can be made in a simple pillar form made of magnetic materials in addition to the effect of the first embodiment, the second plunger 26 can be easily manufactured by cold forging, for example, and manufacturing cost can be reduced.

By separating the second plunger 26 and plunger rod 39, it is not necessary to form the plunger rod 39 with the same quality of the material as the second plunger 26. Therefore, weight saving of the plunger rod 39 is also possible by using a plunger rod 39 made of resin, for example.

It is also possible to reduce the number of parts and assembling processes by providing unitarily the stopper member 35 and the spacer member 33 that are explained in the first embodiment (this is also possible in the first embodiment).

Third Embodiment

Figure 4:
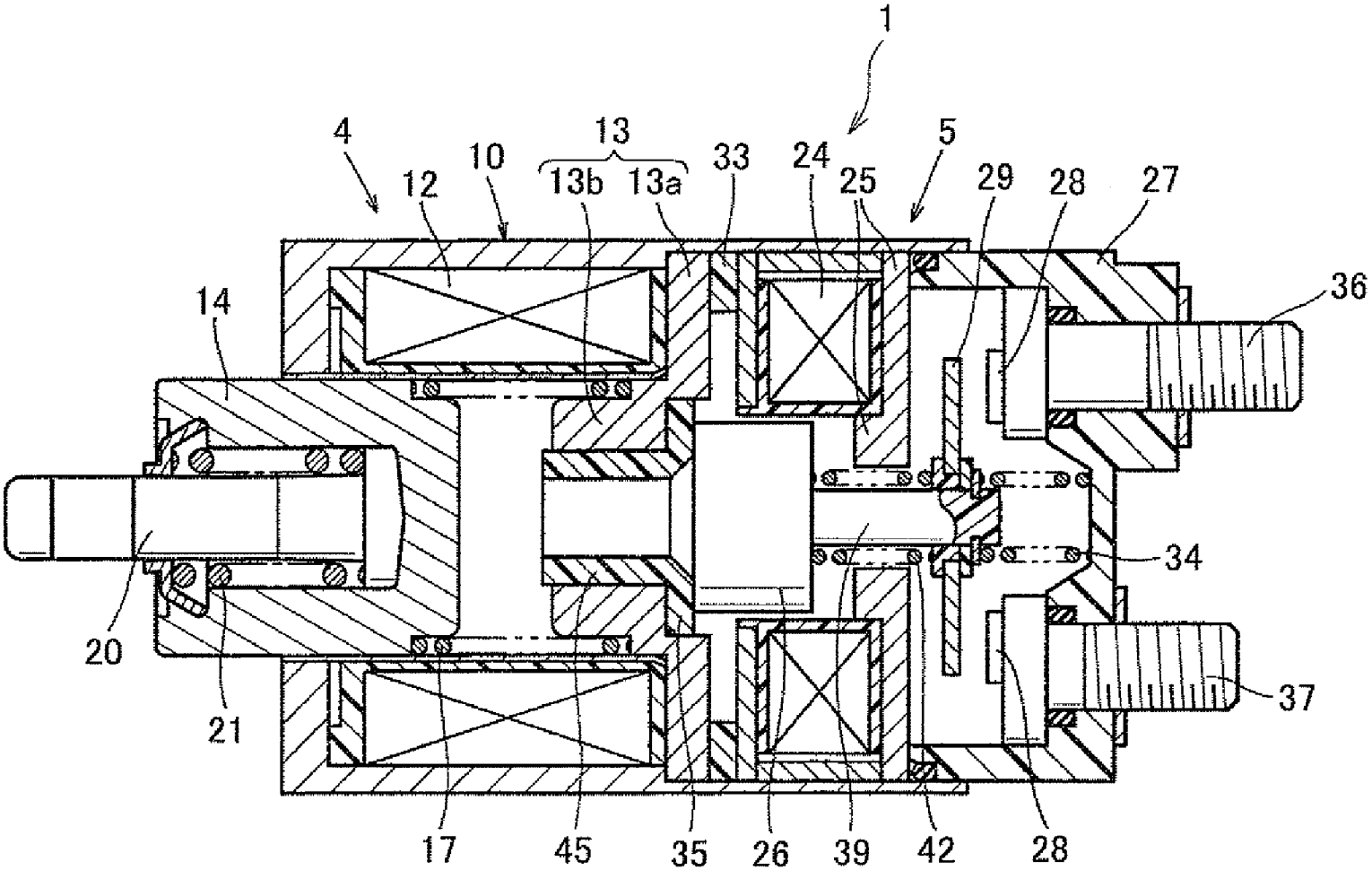
FIG. 4 shows a sectional view of the electromagnetic switch device shown in a third embodiment.

The electromagnetic switch device 1 explained in this third embodiment is an example that attaches a buffer body 45 made of a non-magnetic elastic body to the first fixed iron core 13, as shown in FIG. 4.

A penetration hole is provided that penetrates the central part of iron core part 13*b* is formed in the first fixed iron core 13, and the cylindrical or columnar buffer body 45 is inserted in an inner circumference of the penetration hole.

As shown in FIG. 4, the buffer body 45 is provided unitarily with the stopper member 35, and a tip surface (left end side in the figure) of the buffer body 45 that faces the first plunger 14 is projected a little from the attraction side of the iron core part 13*b*.

According to the above-mentioned composition, when the pinion solenoid 4 operates, i.e., when the first coil 12 is energized and the first plunger 14 is attracted by the iron core part 13*b*, the end surface of the first plunger 14 contacts the tip surface of the buffer body 45 that is projected a little from the attraction side of the iron core part 13*b* before contacting the attraction side of the iron core part 13*b*, then contacts the attraction side of the iron core part 13*b* while bending the buffer body 45.

By this, since the buffer body 45 bends just before the end surface of the first plunger 14 contacts the attraction side of iron core part 13*b*, an impact power at the time the first plunger 14 and the iron core part 13*b* collide is absorbed, thus the collision sound generated at the time of the collision can be reduced.

Figure 5:
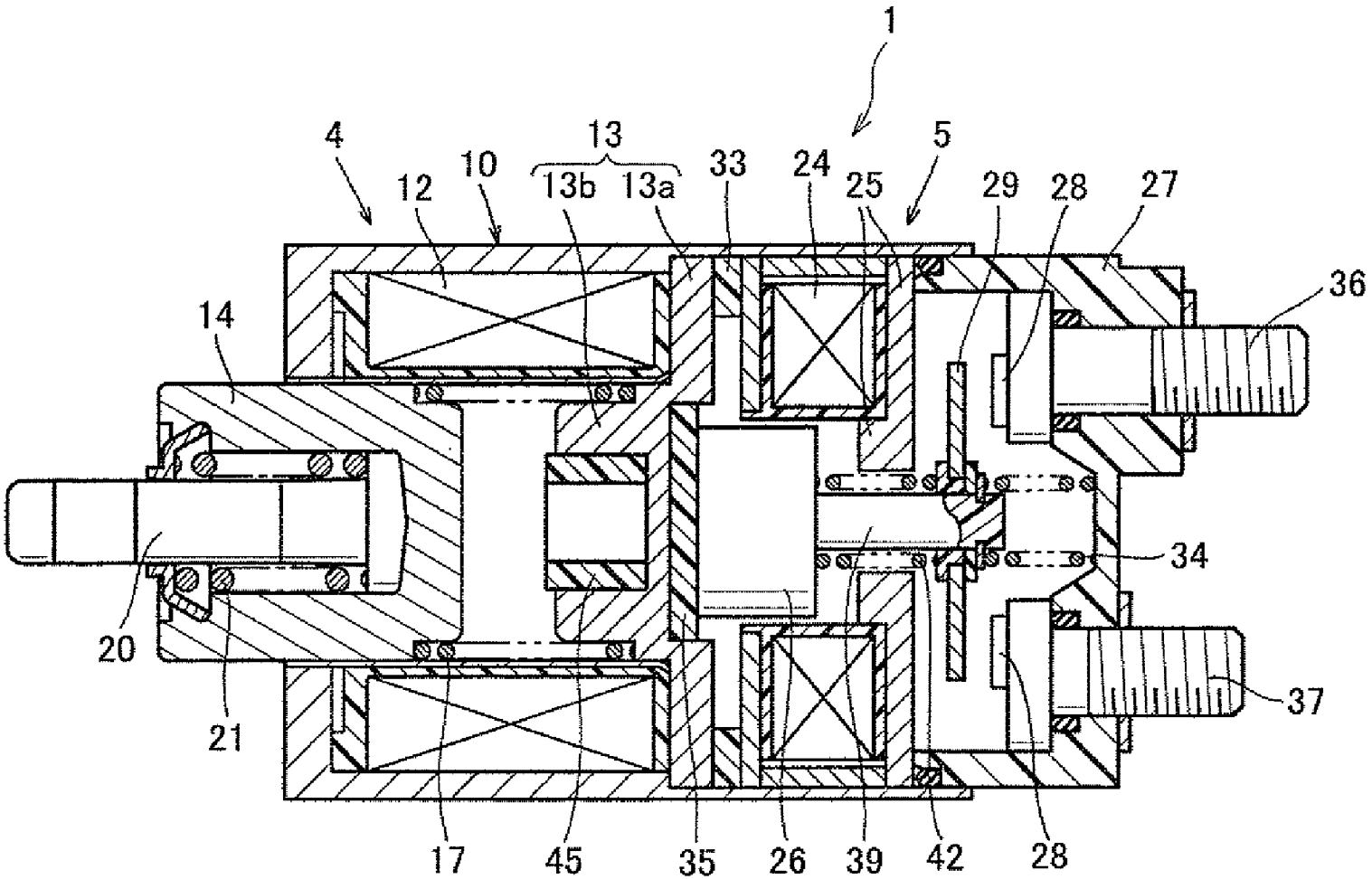
FIG. 5 shows a sectional view of another electromagnetic switch devices shown in the third embodiment.

Although FIG. 4 shows the example that the buffer body 45 and the stopper member 35 are formed unitarily, the buffer body 45 and the stopper member 35 can also be formed separately, as shown in FIG. 5, for example.

Fourth Embodiment

Figure 6:
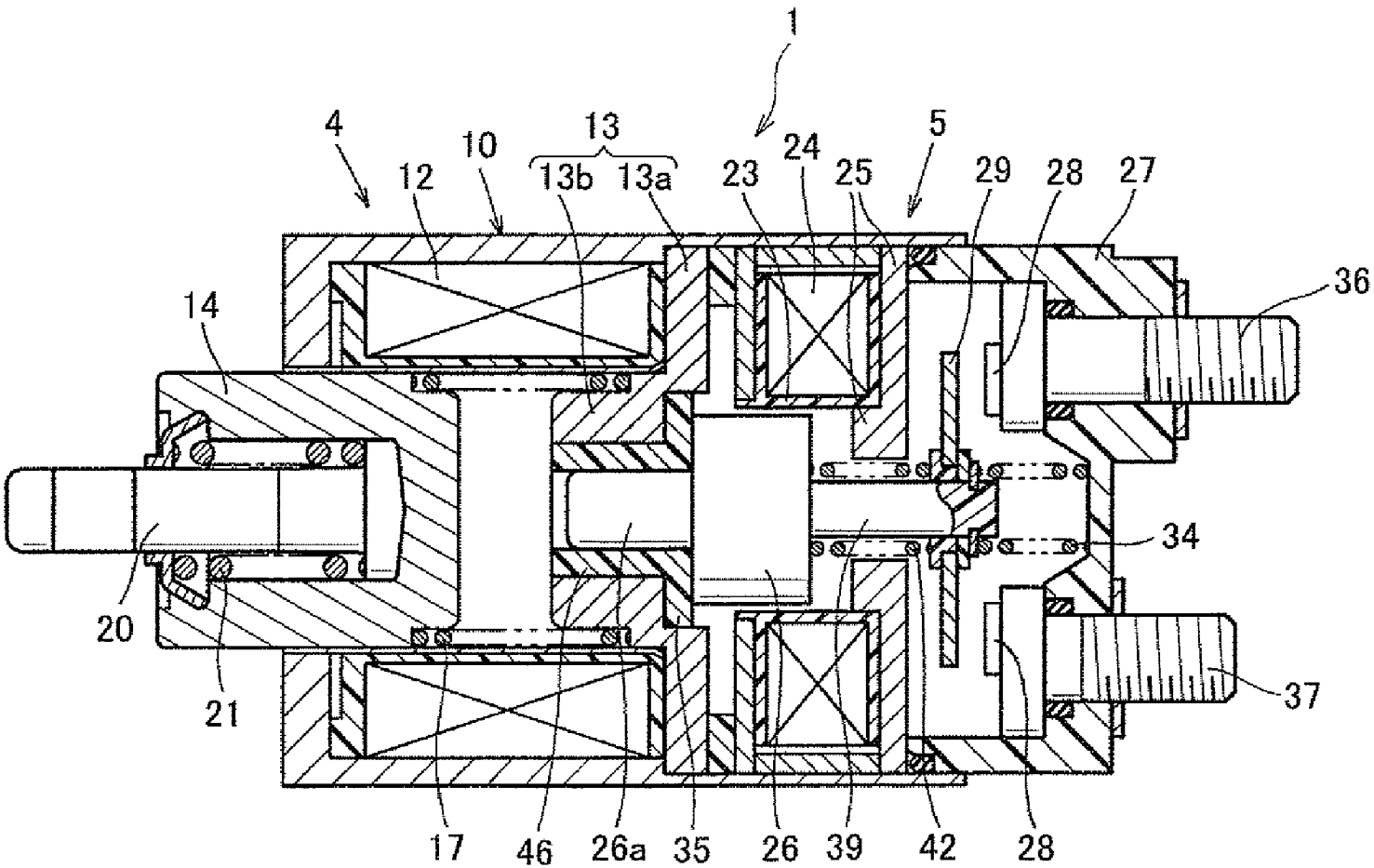
FIG. 6 shows a sectional view of the electromagnetic switch device shown in a fourth embodiment.

The electromagnetic switch device 1 explained in this fourth embodiment is an example where the second plunger 26 is provided with a plunger axis part 26*a*, and supports the plunger axis part 26*a* movably in the axial direction by a guiding member 46 made of a nonmagnetic material, as shown in FIG. 6.

A penetration hole is provided that penetrates a central part of the iron core part 13*b* in an axial direction is formed in the first fixed iron core 13, and the guiding member 46 is fitted in and attached to the penetration hole.

The guiding member 46 is formed unitarily with the stopper member 35, and a guide hole having a round section that penetrates in an axial direction at the radial center of the guiding member.

The guide hole is penetrated from an end surface in an axial direction of the guiding member 46 to a surface of the stopper member 35.

The plunger axis part 26*a* that projects in an axial direction is provided in a central part in a radial direction of a surface of the second plunger 26 that contacts the stopper member 35, and the plunger axis part 26*a* is inserted in a guide hole formed in the guiding member 46.

That is, the plunger axis part 26*a* is formed in a cylindrical or columnar shape having an outer diameter smaller than that of the second plunger 26 so that it can be inserted in the guide hole.

However, a gap formed between an inner diameter of the guide hole and the outer diameter of the plunger axis part 26*a* is set smaller than a gap formed between an outer diameter of the second plunger 26 and an inner diameter of the bobbin 23.

According to the above-mentioned composition, since the plunger axis part 26*a* is supported via the guiding member 46, a movement in a radial direction of the second plunger 26 can be suppressed.

By this, the oscillation amplitude is decreased when an external vibration acts on the second plunger 26, and it is difficult for the perimeter of the second plunger 26 to contact the inner circumference of the bobbin 23.

That is, since a predetermined gap can be secured between the perimeter of the second plunger 26 and the inner circumference of a bobbin 23 when the second plunger 26 moves in the axial direction, wear of the bobbin 23 caused by the contacting (sliding) with the second plunger 26 can be reduced, and sliding durability can be improved.

Although the example that forms the guiding member 46 and the stopper member 35 unitarily is explained in the present embodiment, the guiding member 46 and the stopper member 35 can also be formed separately.

[Modification]

Although the above-mentioned first embodiment explains the operation when the restart occurs during the engine slowing down, this explanation of the operation is just an example.

Operating the pinion solenoid 4 previously mentioned may operate the motor solenoid 5 after the end surface of the pinion 2 contacts the ring gear 3, even when the restart occurs after the engine has completely stopped its rotation, for example.

Or even if it is before the restart occurs, operating the pinion solenoid 4 during the engine slowing down may operate the motor solenoid 5 at the time the restart occurs after engaging the pinion 2 to the ring gear 3.

What is claimed is:

1. An electromagnetic switching device for starters comprising:

a solenoid for pinion extrusion comprising:

a first coil that forms an electromagnet by energization;

a first fixed iron core that is magnetized by the energization to the first coil; and a first plunger that moves in an inner circumference of the first coil in an axial direction by attraction of the magnetized first fixed iron core;

a pinion disposed on a starter's output shaft extruded by an engine's ring gear side interlocking with a movement of the first plunger;

a solenoid for motor energization comprising:

a second coil that forms an electromagnet by energization;

a second fixed iron core that is magnetized by the energization of the second coil; and a second plunger that moves in an inner circumference of the second coil in an axial direction by attraction of the magnetized second fixed iron core;

a main switch that intermits a current flowing to a starter motor interlocking with a movement of the second plunger;

wherein, the solenoid for pinion extrusion and the solenoid for motor energization are arranged in line in an axial direction, there is provided a cylindrical case with a bottom in one side and an opening in another side, the solenoid for pinion extrusion is accommodated in the bottom side of the case and the solenoid for motor energization is accommodated in the opening side of the case to constitute the electromagnetic switching device for starters unitarily, the solenoid for pinion extrusion and the solenoid for motor energization are so constituted that a direction where the first plunger moves by attraction of the first fixed iron core and a direction where the second plunger moves by attraction of the second fixed iron core are in the same direction, the first fixed iron core of the solenoid for pinion extrusion is constituted of a ring-shaped iron core plate arranged at a top side of the case to the first coil, and an iron core part provided unitarily with an inner circumference side of the iron core plate arranged at an inner circumference of the first coil facing the first plunger, the first fixed iron core has its anti-plunger side end surface of the iron core part depressed a predetermined depth D from an anti-coil side end surface of the iron core plate, the solenoid for motor energization has a stopper member made of non-magnetic materials that suppresses a stopping position of the second plunger at the time where the energization to the second coil is stopped, and the stopper member is arranged at a concave portion that is depressed the predetermined depth D of the first fixed iron core.

2. The electromagnetic switching device according to claim 1, wherein, a thickness t of the stopper member is formed smaller than the depth D of the concave portion formed in the first fixed iron core, and a part of the second plunger overlaps the first fixed iron core in the axial direction only by the difference (D−t) of the depth D of the concave portion and the thickness t of the stopper member.

3. The electromagnetic switching device according to claim 2, wherein, the case comprises a first case that forms a yoke of the pinion solenoid and a second case that forms a yoke of the motor solenoid unitarily formed and arranged in line in an axial direction, and a thickness of a portion that connects between the first case and the second case is formed smaller than the cross-sectional areas of a magnetic circuit of the pinion solenoid and the magnetic circuit of the motor solenoid, respectively.

4. The electromagnetic switching device according to claim 1, wherein, the case comprises a first case that forms a yoke of the pinion solenoid and a second case that forms a yoke of the motor solenoid unitarily formed and arranged in line in an axial direction, and a thickness of a portion that connects between the first case and the second case is formed smaller than the cross-sectional areas of a magnetic circuit of the pinion solenoid and the magnetic circuit of the motor solenoid, respectively.

5. The electromagnetic switching device according to claim 1, wherein, the motor solenoid has a plunger rod provided separately from the second plunger that supports a moving contact of the main switch, and the second plunger is constituted of substantially pillar-shaped member of magnetic materials.

6. The electromagnetic switching device according to claim 1, wherein, a penetration hole is provided that penetrates a central part of the iron core part in an axial direction and a guiding member made of non-magnetic materials is provided to the penetration hole, the guiding member is formed either unitarily or separately with the stopper member and has a guide hole that penetrates in an axial direction at the radial center of the guiding member, the second plunger is provided with a plunger axis part that projects in an axial direction (direction towards the first plunger) from a central part in a radial direction of a surface of the second plunger that contacts the stopper member at the time where the energization to the second coil is stopped, and the plunger axis part is inserted in the guide hole and supported movably in the axial direction via the guiding member.

7. The electromagnetic switching device according to claim 6, wherein, a gap formed between an inner diameter of the guide hole and the outer diameter of the plunger axis part is smaller than a gap formed between an outer diameter of the second plunger and an inner diameter of a bobbin that the second coil is wound.

8. The electromagnetic switching device according to claim 1, wherein, a penetration hole is formed in the iron core part that penetrates a central part thereof, a cylindrical or columnar buffer body made of a non-magnetic elastic body that projects in an axial direction (direction towards the first plunger) from a surface of the iron core part side is provided unitarily with the stopper member, the buffer body is inserted into the penetration hole, and a tip surface of the buffer body is projected from attraction side of the iron core part that faces the first plunger.

9. An electromagnetic switching device for starters comprising:

a solenoid for pinion extrusion comprising:

a first coil that forms an electromagnet by energization;

a first fixed iron core that is magnetized by the energization to the first coil; and a first plunger that moves in an inner circumference of the first coil in an axial direction by attraction of the magnetized first fixed iron core;

a pinion disposed on a starter's output shaft extruded by an engine's ring gear side interlocking with a movement of the first plunger;

a solenoid for motor energization comprising:

a second coil that forms an electromagnet by energization;

a second fixed iron core that is magnetized by the energization of the second coil; and a second plunger that moves in an inner circumference of the second coil in an axial direction by attraction of the magnetized second fixed iron core;

a main switch that intermits a current flowing to a starter motor interlocking with a movement of the second plunger;

wherein, the solenoid for pinion extrusion and the solenoid for motor energization are arranged in line in an axial direction, there is provided a cylindrical case with a bottom in one side and an opening in another side, the solenoid for pinion extrusion is accommodated in the bottom side of the case and the solenoid for motor energization is accommodated in the opening side of the case to constitute the electromagnetic switching device for starters unitarily, and the solenoid for pinion extrusion and the solenoid for motor energization are so constituted that a direction where the first plunger moves by attraction of the first fixed iron core and a direction where the second plunger moves by attraction of the second fixed iron core are in the same direction.

10. The electromagnetic switching device according to claim 9, wherein, the case is provided unitarily with a first case that forms a yoke of the pinion solenoid and a second case that forms a yoke of the motor solenoid arranged in line in an axial direction, and a thickness of a portion that connects between the first case and the second case is formed smaller than the cross-sectional areas of a magnetic circuit of the pinion solenoid and the magnetic circuit of the motor solenoid, respectively.

* * * * *

UNITED STATES PATENT AND TRADEMARK OFFICE

CERTIFICATE OF CORRECTION

PATENT NO. : 8,289,110 B2
APPLICATION NO. : 12/914080
DATED : October 16, 2012
INVENTOR(S) : Masami Niimi et al.

It is certified that error appears in the above-identified patent and that said Letters Patent is hereby corrected as shown below:

Please amend claim 4 as follows:

Column 14, line 4, please change “claim 1” to --claim 2--

Signed and Sealed this
Twenty-ninth Day of January, 2013

David J. Kappos

David J. Kappos
*Director of the United States Patent and Trademark Office*